United States Patent [19]

Schatz

[11] Patent Number: 4,467,486

[45] Date of Patent: Aug. 28, 1984

[54] HEADBOARD BRACKET

[75] Inventor: Joshua G. Schatz, Alexandria, Va.

[73] Assignee: Virginia Adjustable Bed Manufacturing Corp., Alexandria, Va.

[21] Appl. No.: 411,656

[22] Filed: Aug. 26, 1982

[51] Int. Cl.[3] ..... F16M 11/00; A47C 19/00; A47F 5/00; A47H 1/10

[52] U.S. Cl. ..... 5/508; 248/201; 248/300; 403/4; 5/53 R; 5/282 R

[58] Field of Search ..... 5/53 R, 53 B, 53 C, 5/53 D, 508, 282 R, 285; 403/4; 248/220.2, 558, 289.1; 248/201, 300, 274

[56] References Cited

U.S. PATENT DOCUMENTS

| | | | |
|---|---|---|---|
| 429,430 | 3/1890 | Elliott | 248/201 |
| 1,343,527 | 6/1920 | Stoelzel | 248/454 |
| 2,585,985 | 2/1952 | Anderson | 248/201 |
| 2,731,229 | 1/1956 | Seitz | 248/300 |
| 2,855,107 | 10/1958 | Roth | 248/201 |
| 3,185,424 | 5/1965 | Sloop | 248/300 |
| 3,730,472 | 5/1973 | Dale | 248/300 |
| 4,371,138 | 2/1983 | Roberts | 248/201 |

*Primary Examiner*—Alexander Grosz
*Assistant Examiner*—Vinh Luong
*Attorney, Agent, or Firm*—Burns, Doane, Swecker & Mathis

[57] ABSTRACT

The present invention relates to a bracket for securing a headboard to a base of a bed and adapted for accommodating mattresses of two different lengths. The bracket includes an elongated bar having a first angled section and a second angled section at a first end thereof. Each section includes openings adapted to receive fasteners for selectively securing an appropriate one of the sections substantially flush with a portion of the base dependent upon the length of the mattress to be employed. A clevis is secured to a second end of the bar. A swing plate is adapted to cooperate with the clevis and is adapted to be fastened to the headboard. A pin is provided for releasably, swingably securing the swing plate to the clevis. The present invention provides a multitude of adjustments of the bracket relative to both the headboard and the base such that the bracket according to the present invention may be employed with a wide variety of headboard/mattress configurations.

11 Claims, 5 Drawing Figures

HEADBOARD BRACKET

BACKGROUND AND SUMMARY OF THE PRESENT INVENTION

The present invention relates to a bracket for connecting a headboard to a base of a bed. More particularly, the present invention relates to a bracket adapted for use with a platform-type bed which bracket is adapted to accommodate mattresses of two different lengths.

In the bedding industry, there are generally two available lengths for mattresses of varying widths. In particular, standard mattresses are either of a 74 inch length or an 80 inch length. Platform-type beds have recently become increasingly popular. Such a bed comprises a base generally of rectangular shape upon which a platform adapted to support a mattress is arranged. The base is substantially smaller in all dimensions when compared to the dimensions of the platform and/or the mattress. This platform-type bed is particularly suited for adjustable beds, i.e., beds which have head and foot portions which may be selectively raised and lowered according to the desires of the user. With such an adjustable bed, it is often desirable to attach a headboard securely to the base of the bed without interferring with movement of the head portion of the mattress. Accordingly, an elongated bracket is desired which bracket extends between the base and the headboard. However, as noted previously, mattresses are provided in generally two standard lengths. In practice, the base of the bed is generally not altered to accommodate a platform for supporting either length of mattress. Therefore, the longer mattress extends further beyond a head end of the base.

In a known arrangement, a separate bracket was provided for each length of the mattress. Also, a separate bracket was often provided for attaching the right and left side of the headboard to the right and left side of the base, respectively. Such multiple brackets both increased the cost of manufacture and increased the complexity and time required for attaching the headboard to the base. In addition, while standards have recently been adopted in the industry for the width of headboards, many older headboards have widely varying widths. Such varying widths of headboards further complicate the attachment of the desired headboard to the base of a platform-type bed. Further, it is desirable that the bracket be aesthetically pleasing and at least somewhat obscured after installation.

Accordingly, it is an object of the present invention to overcome the various difficulties noted above for providing a bracket for attaching a headboard to a base of a platform-type bed.

It is a further object of the present invention to provide a single bracket for securing a headboard to a base of a platform-type bed which bracket may be used with two standard lengths of mattresses while retaining proper spacing between the mattress and the headboard. In addition, an object of the present invention is to provide a bracket which may be used for attaching either the right or the left hand side of the headboard to the base of a platform-type bed.

A further object of the present invention is to provide a bracket which offers a wide range of adjustments such that headboards of varying width and configurations may be easily attached to a base of a platform-type bed. A still further object of the present invention is to provide a bracket which is relatively inexpensive to manufacture and is relatively simple to install. Another object is to provide a bracket which is aesthetically pleasing and is obscured from view when installed.

These objects and others are accomplished by a bracket according to the present invention for connecting a headboard to a base of a bed. The bracket includes an elongated bar having an arrangement for connecting the bracket to the headboard disposed at a first end of the bar. A second end of the bar includes first and second sections which are angled with respect to both the remainder of the bar and each other. Each section includes openings adapted to receive fasteners for securing the appropriate section substantially flush against a portion of the base. In the preferred embodiment, the angles of the first and second sections are selected such that the bracket can accommodate mattresses of two different lengths.

Further in the preferred embodiment, the arrangement for connecting the bracket to the headboard includes a swing plate and a pin for releasably, swingably securing the swing plate to the elongated bar. The swing plate is preferably adapted to cooperate with a clevis having openings in the arms thereof through which the pin may be passed to secure the swing plate to the clevis.

Still further in, the preferred embodiment, the openings arranged in each of the angled sections are elongated such that horizontal adjustment of the bracket relative to the base is permitted. In addition, the swing plate is provided with openings for receiving fasteners to be secured to the headboard which openings are elongated such that vertical adjustment of the swing plate relative to the headboard is permitted.

In accordance with a further aspect of the present invention, an arrangement is provided for adjusting the position of the openings in the swing plate relative to the longitudinal axis of the elongated bar. The arrangement preferably includes bores on the swing plate adapted to receive the pin which bores are offset relative to a longitudinal axis of the openings in the swing plate for receiving the fasteners. In this way, the swing plate may be releasably secured to the elongated bar by the pin in two different positions such that the openings for receiving the fasteners are adjusted horizontally relative to the axis of the elongated bar. Further, by providing a pin for securing the swing plate to the elongated bar, the bracket may be readily reversed and the pin inserted accordingly such that the bracket can be used for securing either the right or the left hand side of the headboard to the base.

BRIEF DESCRIPTION OF THE DRAWINGS

A preferred embodiment of the present invention will be described in greater detail with reference to the accompanying drawings, wherein like members bear like reference numerals, and wherein.

DETAILED DESCRIPTION OF THE PREFERRED EMBODIMENT

Figure 1:
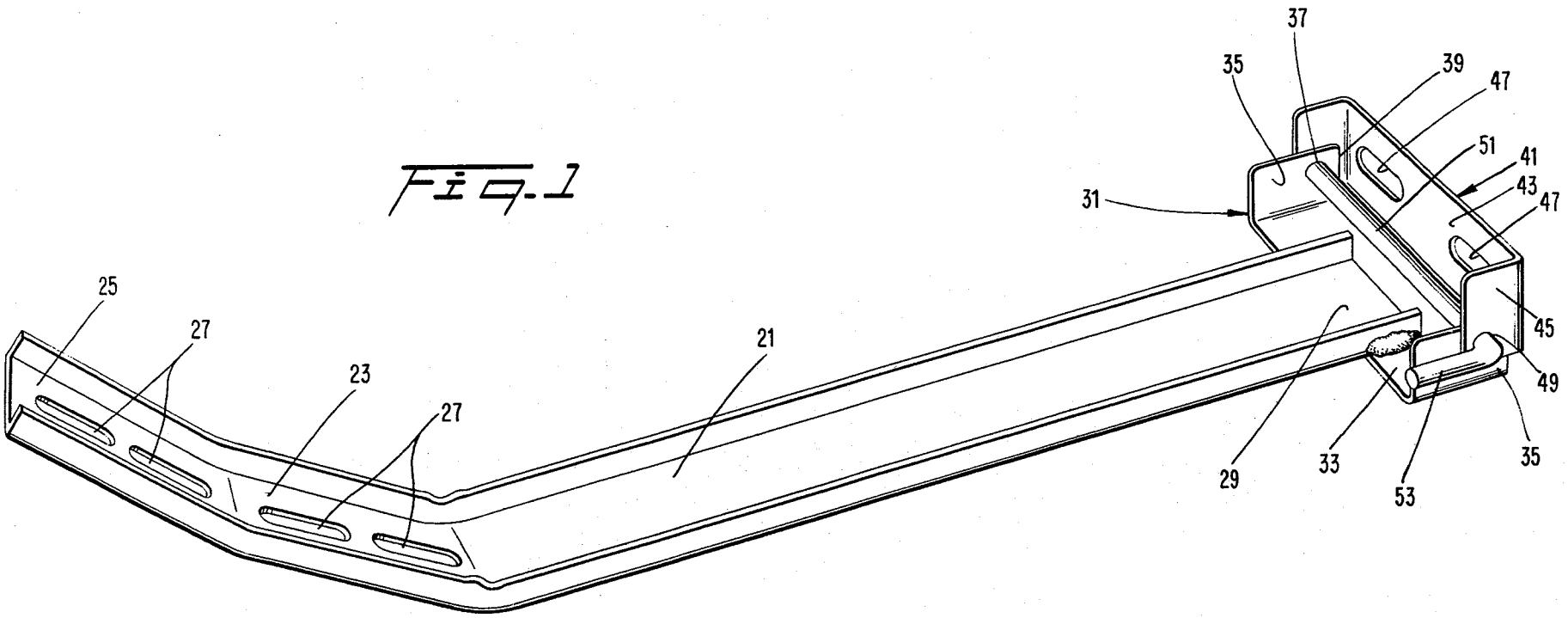
FIG. 1 is a perspective view of a bracket according to the present invention.

With reference to FIG. 1, the bracket according to the present invention includes an elongated bar 21 which is preferably made of steel. The bar may be a simple flat member or, as illustrated, may be a channel bar for improved strength. Arranged at a first end of the bar 21 are first and second angled sections 23, 25, respectively. In the illustrated embodiment, the sections 23, 25 are formed from bent portions of a single elongated bar. The sections 23, 25 are preferably integral portions of the bar 21 both for ease of manufacture and for reducing costs of manufacturing the bracket. However, the angled sections may be secured to the first end of the elongated bar 21 by any other suitable arrangement, for example, by welding.

The sections 23, 25 are angled with respect to the longitudinal axis of the bar 21 and with respect to one another. In the preferred embodiment, the angle between the first section 23 and the bar 21 is approximately 41° while the angle between the second section 25 and the elongated bar 21 is approximately 54°. These angles are selected for reasons to be explained in greater detail below. Each of the angled sections 23, 25 includes elongated slots 27 which are adapted to receive a fastening arrangement such as bolts, screws, or the like.

Secured to a second end 29 of the bar 21 is a clevis 31 including a base portion 33 and a pair of arms 35 extending generally perpendicular to the base portion 33. The clevis 31 may be secured to the second end 29 of the bar 21 by any suitable arrangement, for example, by welding. Each of the arms 35 of the clevis 31 includes a bore 37 near a forward edge 39 of the arms 35. The bores 37 in the arms 35 are aligned along a single longitudinal axis.

A swing plate 41 is adapted to cooperate with the clevis 31. The swing plate includes a base portion 43 and two arms 45 arranged generally perpendicular to the base portion 43. The swing plate base portion 43 includes two aligned, spaced-apart, elongated openings 47 which are arranged generally along a central longitudinal axis of the swing plate base portion 43. The openings 47 are adapted to receive fasteners such as screws, bolts or the like.

Each of the arms 45 of the swing plate 41 is provided with a bore 49 having a diameter, substantially the same as the diameter of the bores 37 in the arms 35 of the clevis 31. The bores 49 in the swing plate arms 45 are aligned and arranged toward one side of the arms 45, i.e., off-center with respect to the central longitudinal axis of the swing plate base portion 43 along which the openings 47 are arranged. The distance between the arms 45 of the swing plate 41 is greater than the distance between the arms 35 of the clevis 31 such that the swing plate 41 is adapted to receive the clevis arms 35 within the swing plate arms 45.

An elongated pin 51 is adapted to pass through the swing plate bores 49 and the clevis bores 37 to releasably, swingably secure the swing plate 41 to the clevis 31. The pin 51 includes a portion 53 which is bent with respect to a longitudinal axis of the pin 51 to prevent the pin from passing completely through the bores 37, 49. In this way, pivotal movement of the swing plate 41 is permitted about the pin 51 while longitudinal movement of the swing plate 41 relative to the clevis 31 is limited by abutment of a respective one of the swing plate arms 45 with a surface of the clevis arms 35.

Figure 4:
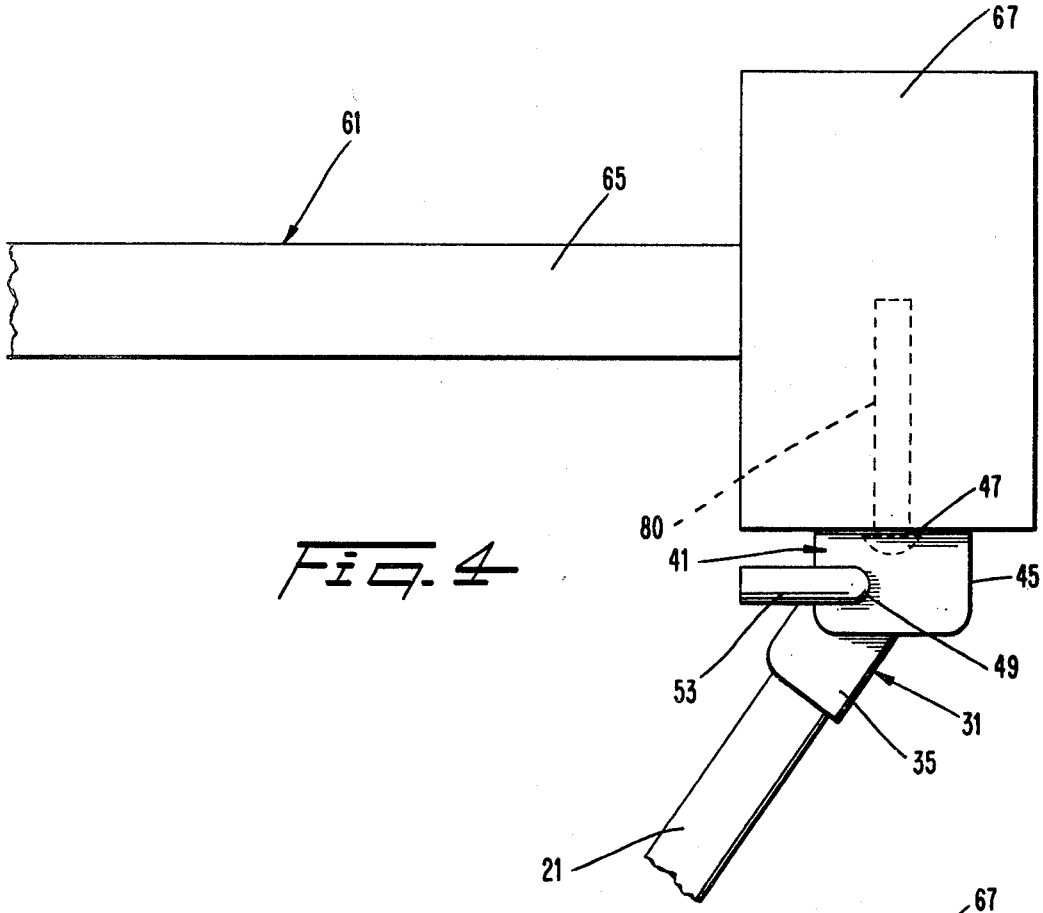
FIG. 4 is a partial top view of the bracket according to the present invention with the swing plate secured to the headboard and arranged in a first position relative to the elongated bar.
Figure 5:
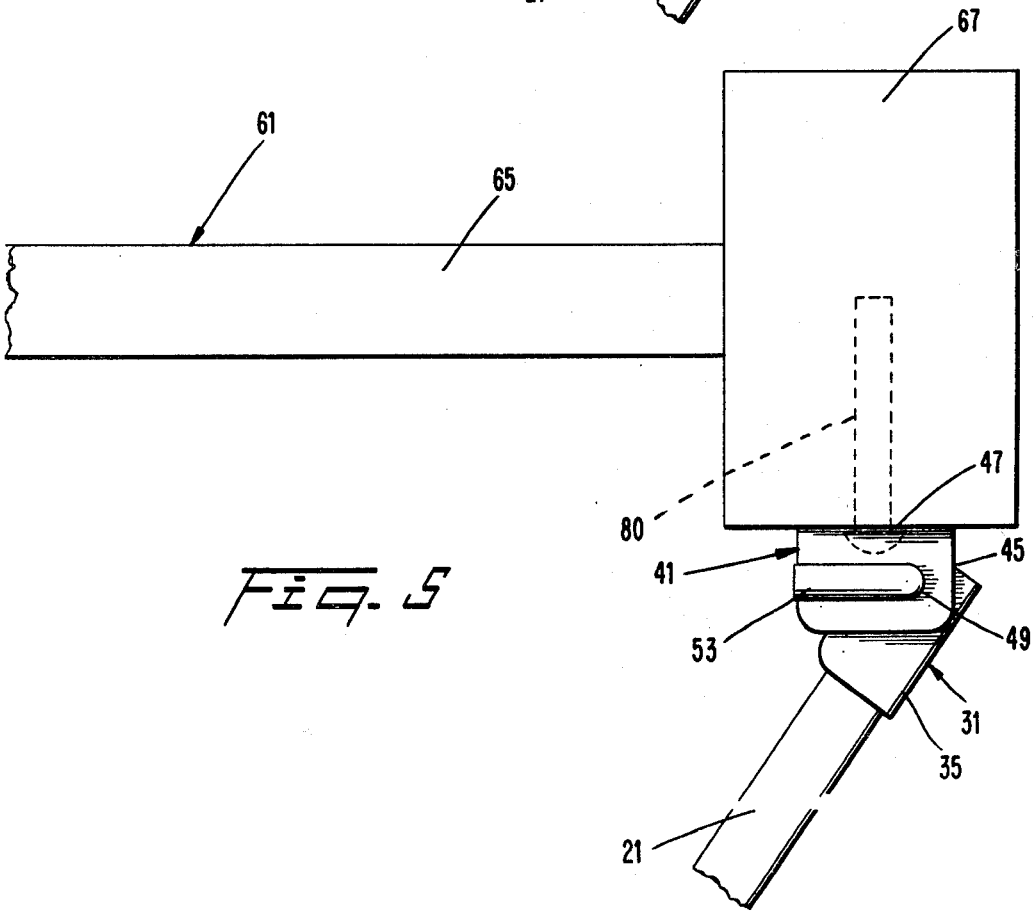
FIG. 5 is a partial top view of the bracket according to the present invention with the swing plate secured to the headboard in a second position relative to the elongated bar of the bracket.

In the illustrated embodiment, each of the swing plate arms 45 is arranged on an outside of a respective one of the clevis arms 35 such that longitudinal movement of the swing plate 41 is limited in two directions by abutment of a respective one of the swing plate arms 45 with an outside surface of the clevis arms 35. However, it should be noted that the pin 51 is sufficiently long such that the swing plate arm 45 remote from the bent portion 53 of the pin 51 could be arranged inside the respective clevis arm 35. In this way, the location of the elongated openings 47 in the base portion 43 of the swing plate 41 can be moved in a direction perpendicular to the longitudinal axis of the elongated bar 21. With such an arrangement, longitudinal movement of the swing plate 41 in one direction is prevented by abutment of an outside surface of the swing plate arm 45 remote from the bent pin portion 53 with an inside surface of the appropriate clevis arm 35. Longitudinal movement of the swing plate in the opposite direction is resisted by gravity in the installed position of the bracket in which position the swing plate 41 is arranged substantially vertically (FIGS. 4 and 5).

Figure 2:
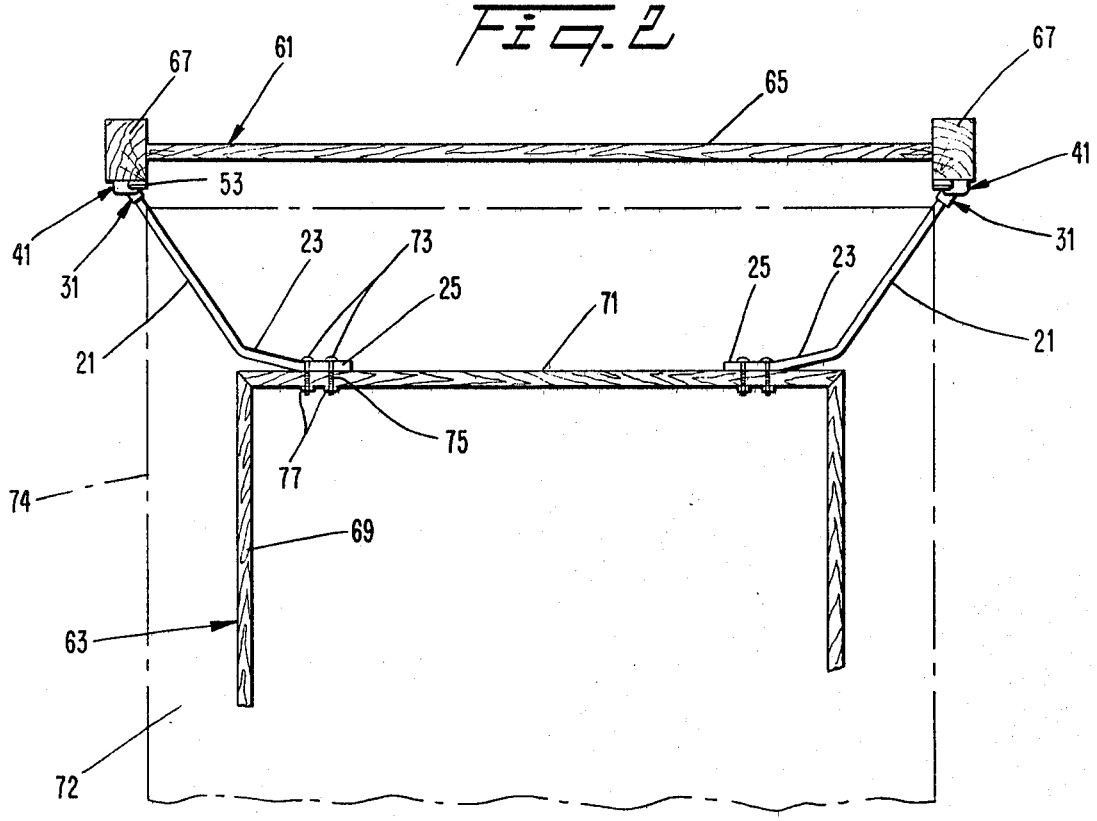
FIG. 2 is a top view of a pair of brackets according to the present invention secured to a headboard and accommodating a first mattress length.

With reference to FIG. 2, the bracket according to the present invention is adapted to secure a headboard 61 to a base 63 of a platform-type bed. The headboard may include a center section 65 and a post 67 arranged at each side thereof. In the illustrated embodiment, the headboard 61 is indicative of a general type of headboard. It should be noted that the bracket according to the present invention is adapted for connection to a wide variety of headboards of substantially any configuration.

The base 63 of the platform-type bed includes a pair of side walls 69 and a pair of end walls 71 (only one of which is shown). A platform (not shown) is adapted to support a mattress 72 (shown in phantom lines in FIG. 2) in a known manner. In FIG. 2, the mattress is the standard length of 80 inches.

In order to secure the headboard 61 to the base 63 of the platform-type bed, two brackets according to the present invention are employed. Firstly, a swing plate 41 is releasably, swingably secured to the second end 29 of the elongated bar 21 by the pin 51. The pin 51 is retained in the bores 49, 37 by the force of gravity. It should be noted that due to the relatively simple connection and disconnection of the swing plate with the elongated bar 21 afforded by the pin 51, the swing plate 41 may be releasably, swingably secured in the appropriate location for connection to either post 67 of the headboard 61 by simply reversing the orientation of the elongated bar 21 and the pin 51. In other words, by inserting the pin 51 from an appropriate one of the swing plate arms 45 through the clevis 31, a single bracket according to the present invention may be employed on either side of the bed.

The appropriate angled section 23, 25 of the elongated bar is arranged substantially flush against the end wall 71 of the base 63. The appropriate angled section 23, 25 is selected in accordance with the mattress length. In other words, with reference to FIG. 2, when employing an 80 inch mattress, the second angled section 25 (which has an angle relative to the bar 21 selected for use with an 80 inch mattress) is arranged substantially flush against the end wall 71 of the base 63. The angled section 25 is then loosely secured to the base end wall 71 by passing suitable fasteners 73 through the openings 27 in the second angle section 25. Two openings 27 are provided in order to prevent unwanted rotation of the bracket about the fasteners 73. Such fasteners 73 may comprise bolts which pass through predrilled holes 75 arranged in the end wall 71 of the base 63. The bolts may be secured by suitable nuts 77 and washers if desired. Alternatively, simple wood screws may be employed as the fasteners 73.

The swing plate 41 arranged on the second end 29 of the elongated bar 21 is then aligned with the posts 67 of the headboard 61 by horizontal movement of the bracket such that suitable fasteners can be passed through the openings 47 in the swing plate base portion 43. It should be noted that due to the elongation of the slots 27 in the second angled portion 25, the horizontal movement of the bracket, and hence, a change in the outward extension of the swing plate 41 from the side wall 69 of the base 63, can be easily accomplished. Having determined the proper orientation of the openings 47 in the swing plate 41, the fasteners 73 are tightened to securely hold the second angled section 25 substantially flush against the end wall 79 of the base 63 of the platform-type bed. It should be noted that by attaching the first end of the bracket to the end 79 of the base 63 rather than the side wall 69, the connection is substantially obscured to a person viewing the completely assembled bed. Also, the outward side of the elongated bar 21 and the clevis 31 which partially obscures the swing plate 41 and the pin 51 present a smooth aesthetic appearance from the outer edges of the bed.

The pin 51 is then removed from the openings 37, 49 in the clevis 31 and the swing plate 41, respectively, to release the swing plate 41 from the remainder of the bracket. The swing plate 41 is then secured to the post 67 or other suitable portion of the headboard 61 by passing suitable fasteners 80 (FIGS. 4 and 5) through the openings 47 in the swing plate base portion 43. Such fasteners may be, for example, wood screws, bolts, or the like and are selected in accordance with the type of headboard being used. Also, suitable washers may be employed if desired. The headboard 61 is then arranged such that the bores 49 in the swing plate arms 45 align with the bores 37 in the clevis arms 35. Again, it should be noted that due to the elongation of the openings 47 in the swing plate base 43, vertical adjustment of the swing plate relative to the headboard 61 is readily permitted such that the swing plate arms 45 can be arranged in the appropriate location relative to the clevis arms 35. If necessary, the horizontal position of the bracket may be readjusted by loosening the fasteners 73 securing the angled section 25 to the base end wall 71. After aligning the headboard 61, the pin 51 is reinserted through the bores 49, 37 in the swing plate 41 and the clevis 31, respectively, to secure the headboard 61 to the bracket which is secured to the base 63.

As will be more fully appreciated, the bracket according to the present invention provides a multitude of adjustments of the bracket relative to both the headboard 61 and the end wall 71 of the base 63 to permit the bracket to be used with a wide variety of sizes and configurations of headboards. As noted previously, while standard locations for connections to headboards have recently been adopted, many older headboards are of widely varying dimensions. Accordingly, the adjustability afforded by the present invention is particularly useful for securing older headboards to a new platform-type bed. In addition, further features of the present invention permit the bracket to be adapted for use with still further variations on the platform-type bed.

As illustrated in FIG. 2, the base 63 is a base for a queen size bed having an 80 inch long mattress. However, the bracket according to the present invention, is equally adaptable for use with a queen size bed having a 74 inch mattress, or a twin size bed having either an 80 inch or 74 inch mattress.

Figure 3:
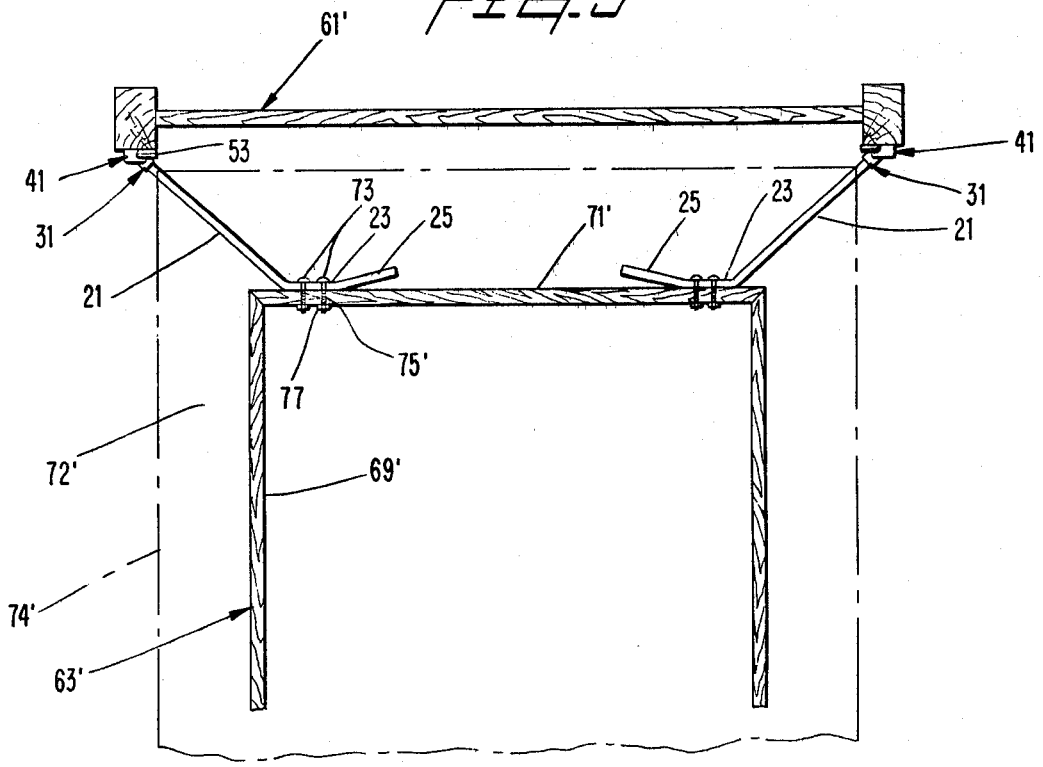
FIG. 3 is a top view similar to FIG. 2 with a pair of brackets according to the present invention secured to a headboard and accommodating a second mattress length shorter than the mattress length illustrated in FIG. 2.

With reference to FIG. 3, a bracket according to the present invention may be employed for connecting a base 63' for a twin bed adapted to support a platform (not shown) for a 74 inch mattress 72' (shown in phantom lines) to a headboard 61' such that the spacing of the headboard 61' from the head of the mattress 72' is appropriate. Firstly, the first angled section 23 of the headboard bracket is loosely secured to an end wall 71' of the base 63'. The remainder of the bracket installation is substantially the same as that described above with reference to FIG. 2.

It should be noted that although the length of the mattress 72' of FIG. 3 is shorter than the length of the mattress 72 of FIG. 2, the distance which an edge 74' of the mattress 72' extends from the side wall 69' of the base 63' is substantially the same as the distance which an edge 74 of the mattress 72 extends from the side wall 69 of the base 63 (FIG. 2). Accordingly, the outward extension of the openings 47 in the swing plate base portion 43 should be substantially the same whether employing the first angled section 23 or the second angled section 25 of the bracket. Accordingly, bores 75 drilled for receiving the fasteners 73 for an 80 inch mattress 72 may not be appropriate for receiving fasteners 73 for the 74 inch mattress 72' (compare FIGS. 2 and 3). In other words, in order to adapt the pre-existing base having bores 75' for use with a 74 inch mattress for use with either length mattress, additional bores in the end wall of the base may be required. Alternatively, a manufacturer of the base may provide multiple openings in the end wall of the base to accommodate either length of mattress. It should be noted that the exact location of the bores 75, 75' in the base end wall 71, 71' is not critical due to the large degree of adjustment permitted by the bracket according to the present invention.

A further adjustment is permitted by the arrangement of the bores 49 in the swing plate arms 45 in an offset location relative to the axis of the openings 47 in the swing plate base portion 43. This adjustment is permitted by rotating the swing plate 41 (after removing the pin 51) about an axis perpendicular serted to swingably secure the swing plate 41 to the elongated bar 21. This adjustment permits the outward or horizontal extension of the openings 47 in the swing plate base portion 43 relative to the axis of the elongated bar 21 to be altered. The distance over which the openings 47 are moved is equal to twice the distance between the axis of the elongated openings 47 and the axis of the bores 49 in the swing plate arms 45. Such an additional adjustment may be sufficient in combination with the elongated slots 27 in the first and second sections 23, 25 to permit a single set of bores 75 in an end wall 71 of a base 63 to be utilized for both a 74 inch mattress and an 80 inch mattress.

With reference to FIG. 4, the swing plate 41 is arranged in a location relative to the elongated bar 21 such that the openings 47 in the swing plate base portion 43 may be extended the maximum outward extension relative to the axis of the elongated bar 21.

With reference to FIG. 5, the swing plate 41 having been rotated 180° about the axis perpendicular to the swing plate base portion 43, is oriented such that the openings 47 in the swing plate base portion 43 extend closer to the respective side wall 69 (not shown) of the base 63 relative to the axis of the elongated bar 21 when compared with the arrangement illustrated in FIG. 4. As noted previously, such adjustability may be necessary in order to connect certain headboards at an appropriate location relative to the base of the platform-type bed.

The present invention provides a bracket which is both relatively simple to construct and simple to install. The bracket according to the present invention is adapted for use with both different width bases and different length mattresses. In addition, the bracket according to the present invention may be readily employed for attaching a wide variety of headboards to the base of a platform-type bed.

Still further, the bracket according to the present invention may be used to secure either a right or left hand side of a headboard to the base of a platform-type bed. The arrangement of elongated openings in both the angled sections and the swing plate of the bracket according to the present invention, permits adjustment of the bracket in both a horizontal and a vertical direction. Moreover, the arrangement of the bores in the swing plate for receiving the pin for releasably securing the swing plate to the clevis permit a further adjustment of the outward extension of the openings of the swing plate relative to the axis of the elongated bar of the bracket. Accordingly, the present invention provides a bracket which is substantially universally adaptable for use with any mattress/headboard combination for a platform-type bed.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A bracket for securing a headboard to a base of a bed, the bracket comprising:

an elongated bar having a first angled section and a second angled section at a first end thereof, each section including at least one opening adapted to receive securement means for selectively fastening one of the sections substantially flush against a portion of the base;

a swing plate cooperating with a second end of the bar and adapted to be fastened to the headboard; and pin means for releasably, swingably securing the swing plate to the second end.

2. The bracket of claim 1, wherein the swing plate includes at least one opening arranged along an axis of the swing plate and adapted to receive securement means for fastening the swing plate to the headboard.

3. The bracket of claim 2, wherein the at least one opening in the base is elongated such that vertical adjustment of the swing plate relative to the headboard is permitted.

4. The bracket of claim 2, further comprising means for adjusting the position of the at least one opening of the swing plate relative to a longitudinal axis of the elongated bar.

5. The bracket of claim 4, wherein the means for adjusting the position of the opening comprises bores on the swing plate for receiving the pin means, the bores being arranged offset from the axis of the at least one opening for receiving the securement means.

6. The bracket of claim 5, further comprising a clevis secured to the second end and cooperating with the swing plate, the clevis including bores arranged near a forward edge of arms of the clevis for receiving the pin means.

7. The bracket of claim 1, wherein the angles of the first and second sections are selected such that the bracket can accommodate mattresses of two different lengths.

8. The bracket of claim 7, wherein the two different lengths accommodated by the first and second sections are 80 inches and 74 inches, respectively.

9. The bracket of claim 1, wherein the openings in the angled sections are elongated such that horizontal adjustment of the bracket relative to the base is permitted.

10. The bracket of claim 1, wherein the bracket is adapted for securing either a right side or a left side of the base to a corresponding side of the headboard.

11. The bracket of claim 1, wherein the first and second sections are formed from bent portions of the elongated bar.

* * * * *